US007175173B2

(12) United States Patent
Anzai et al.

(10) Patent No.: US 7,175,173 B2
(45) Date of Patent: Feb. 13, 2007

(54) FINISHER WITH INCREASED CONVEYANCE SPEED

(75) Inventors: Eiji Anzai, Tokyo (JP); Tetsuo Hirata, Hachioji (JP); Motoki Nakamichi, Hachioji (JP); Norishige Kato, Hachioji (JP); Takehiro Ogushi, Hachioji (JP); Yasushi Saitsu, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 242 days.

(21) Appl. No.: 10/925,258

(22) Filed: Aug. 23, 2004

(65) Prior Publication Data

US 2005/0121847 A1 Jun. 9, 2005

(30) Foreign Application Priority Data

Dec. 8, 2003 (JP) ..... 2003-408583

(51) Int. Cl.
*B65H 29/22* (2006.01)
*B42B 4/00* (2006.01)
*B42C 1/12* (2006.01)

(52) U.S. Cl. ..... 270/58.09; 270/58.07; 270/58.08; 270/58.01; 270/58.11; 399/407

(58) Field of Classification Search ..... 270/58.08, 270/58.09, 58.07, 58.1, 58.11; 399/407, 399/408, 409, 410
See application file for complete search history.

(56) References Cited

U.S. PATENT DOCUMENTS

| | | | | |
|---|---|---|---|---|
| 5,083,760 | A * | 1/1992 | Yamazaki et al. | 270/58.11 |
| 6,002,912 | A * | 12/1999 | Takeda | 399/405 |
| 2005/0084308 | A1 * | 4/2005 | Nakamura et al. | 399/407 |
| 2005/0121847 | A1 * | 6/2005 | Anzai et al. | 270/58.08 |

FOREIGN PATENT DOCUMENTS

| | | | |
|---|---|---|---|
| JP | 06135620 | A * | 5/1994 |
| JP | 2003212423 | A * | 7/2003 |
| JP | 2004284779 | A * | 10/2004 |
| JP | 2005074579 | A * | 3/2005 |
| JP | 2005172890 | A * | 6/2005 |

* cited by examiner

*Primary Examiner*—Douglas A. Hess
(74) *Attorney, Agent, or Firm*—Squire, Sanders & Dempsey L.L.P.

(57) ABSTRACT

An image forming system includes: an image forming apparatus capable of conveying a recording sheet at a predetermined speed; at least one finisher capable of conveying the sheet eject from the image forming apparatus at a prescribed speed to process the sheet; and a controller for changing a conveyance speed of the recording sheet in the finisher to be higher than that of the sheet in the image forming apparatus.

15 Claims, 5 Drawing Sheets

FINISHER WITH INCREASED CONVEYANCE SPEED

BACKGROUND OF THE INVENTION

The present invention relates to an image forming system composed of an image forming apparatus connected with a finisher for conducting such processing as punching, folding, stapling and shifting.

An image forming system connected with a finisher for conducting such processing as punching, folding, stapling and shifting to sheet with an image formed thereon is widely used as a system configured on the basis of a high speed image forming apparatus such as an image forming apparatus based on electrophotographic technology.

In the finisher, processing such as folding and stapling is carried out to sheet, which is temporarily stopped. Accordingly, to prevent collision of the sheets of paper conveyed one after another, the conveyance speed is increased immediately before and after a processing station, thereby ensuring a wide space between sheets of paper (Official Gazette of Japanese Patent Tokkaihei 5-16569). When such control is used, a sensor is installed at the sheet inlet of the finisher, the conveyance speed is increased based on the signal for detecting the trailing edge of the traveling sheet.

To ensure multiple types of finishing, an image forming system equipped with a plurality of finishers is proposed (Official Gazette of Japanese Patent Tokkai 2002-59496 and 2002-137503). In such an image forming system equipped with the plurality of finishers, not much consideration is given to the operation stability and efficiency in the management of the sheet conveyance speed as the overall image forming system.

When designing an image forming system equipped with a plurality of finishers, control will become complicated if each finisher is provided with the conveyance speed control function as in Official Gazette of Japanese Patent Tokkaihei 5-16569, and sheet conveyance control is separately carried out. Such a trouble as jamming is likely to occur and finishing efficiency is reduced, with the result that the efficiency of the overall image forming system will be deteriorated.

Official Gazette of Japanese Patent Tokkaihei 11-301920 discloses an image forming system provided with a finisher where finishing designation information and the information on the sheet attributes are sent from the image forming apparatus to the finisher where finishing is performed. However, such information is not sufficient for effective sheet conveyance control in the finisher and high speed processing in the finisher. For this purpose, it is necessary to capture information on the sheet conveyance speed and sheet ejection timing at the sheet ejection port of the finisher in the preceding step, namely, the finisher of the preceding step in an image forming apparatus and a plurality of finishers. Such information must be obtained in the finisher of the succeeding stage.

In the prior art, this type of information has been created in the finisher of the succeeding stage by allowing the model of the preceding apparatus to be identified by the succeeding model.

The control of this conveyance will be explained with reference to FIG. 1.

Timing of ejecting of sheet P and ejection conveyance speed H from the finisher Ml of the preceding stage are obtained from the rotation speed of the ejection roller R and distance D between the ejection sensor S and ejection port.

Based on the aforementioned information, the finisher M2 of the succeeding stage performs various conveyance control.

In the prior art, the aforementioned information has been created in the finisher of the succeeding stage by allowing the model of the preceding apparatus to be identified by the succeeding model, as described above. To put it another way, if the model of the apparatus in the preceding stage is identified, the sensor distance D in the apparatus of the preceding stage and sheet ejection conveyance speed H in various operation modes of the model can be obtained. Thus, the finisher of the succeeding stage is provided with a table showing the correspondence between the model of the finisher of the preceding stage, sensor distance D and ejection conveyance speed H in various operation modes.

However, when there is an addition of a new function resulting from improvement of the finisher or modification of the ejection conveyance speed, or when a new model is connected as the finisher of the preceding stage, this table must be rewritten. For this purpose, the model must be changed due to the relationship with other finisher although there is no change in the function of the finisher. Even if there is no change of the model, table rewriting service is required. This raises the problem of increased servicing loads.

SUMMARY OF THE INVENTION

The object of the present invention is to solve the aforementioned problems in an image forming system equipped with a finisher.

The aforementioned object of the present invention can be achieved by any one of the following Structures (1) through (17).

(1) An image forming system comprising: an image forming apparatus capable of conveying a recording sheet at a predetermined speed; at least one finisher capable of conveying the sheet ejected from the image forming apparatus at a prescribed speed to process the sheet; and a controller for changing a conveyance speed of the recording sheet in the finisher to be higher than that of the sheet in the image forming apparatus.

(2) The image forming system of Structure (1), wherein the controller changes the conveyance speed of the recording sheet in the finisher after the sheet has been delivered from the image forming apparatus to the finisher.

(3) The image forming system of Structure (2), wherein the image forming apparatus comprises a sheet detection sensor provided in the vicinity of a sheet ejection position thereof, and an information transmitter for transmitting information on a sheet conveyance speed in the image forming apparatus and a distance between the sheet detection sensor and the sheet ejection position, to the finisher.

(4) The image forming system of Structure (2), wherein the image forming apparatus has a plurality of sheet conveyance modes including different sheet conveyance speeds, and the finisher conveys the sheet at a sheet conveyance speed higher than that in the plurality of sheet conveyance modes.

(5) The image forming system of Structure (1), comprising a first finisher connected with the image forming apparatus and a second finisher connected with the first finisher.

(6) The image forming system of Structure (5), wherein the first finisher comprises a sheet detection sensor provided in the vicinity of a sheet ejection position thereof, and an information transmitter for transmitting information on the sheet conveyance speed in the first finisher and a distance between the sheet detection sensor and the sheet ejection position, to the second finisher.

(7) An image forming system comprising: an image forming apparatus capable of ejecting a recording sheet to a next processing station at a predetermined speed; at least one finisher capable of conveying at a prescribed speed the sheet ejected from the image forming apparatus to process the sheet; and a controller for changing a conveyance speed of the recording sheet in the finisher to be higher than an ejection speed of the sheet ejected from the image forming apparatus.

(8) The image forming system of Structure (7), wherein the controller changes the conveyance speed of the sheet in the finisher after the sheet has been delivered from the image forming apparatus to the finisher.

(9) The image forming system of Structure (7), wherein the image forming apparatus has a plurality of sheet conveyance modes including different sheet conveyance speeds, and the finisher conveys the sheet at a sheet conveyance speed higher than that in the plurality of sheet conveyance modes.

(10) An image forming system comprising: an image forming apparatus capable of conveying a recording sheet at a predetermined speed; at least one finisher capable of changing a conveyance speed of the sheet therein for processing the sheet ejected from the image forming apparatus; an information transmitter for transmitting information on a sheet conveyance speed in the image forming apparatus to the finisher; and a controller for controlling the conveyance speed in the finisher according to the information from the information transmitter.

(11) The image forming system of Structure (10), wherein the image forming apparatus comprises a sheet detection sensor provided in the vicinity of a sheet ejection position of the image forming apparatus, and the information transmitter transmits information on a distance between the sheet detection sensor and the sheet ejection position and the sheet conveyance speed in the image forming apparatus, to the finisher.

(12) The image forming system of Structure (11), wherein the controller controls the conveyance speed in the finisher to be higher than a conveyance speed at the sheet ejection position of the image forming apparatus.

(13) An image forming system comprising: a first processing apparatus for conveying a recording sheet to a next processing station at a first conveyance speed, having a sheet detection sensor in the vicinity of a sheet ejection position; a second processing apparatus for receiving the sheet ejected from the first processing apparatus, conveying at a second conveyance speed and conducting a desired processing to the sheet; an information transmitter for transmitting information on a distance between the sheet detection sensor and the sheet ejection position and the first conveyance speed, to the second processing apparatus; and a controller for controlling the second conveyance speed according to the information from the information transmitter.

(14) The image forming system of Structure (13), wherein when the sheet is delivered from the first processing apparatus to the second processing apparatus, the controller controls so that first conveyance speed is equal to the second conveyance speed.

(15) The image forming system of Structure (13), wherein after the sheet has been delivered from the first processing apparatus to the second processing apparatus, the controller makes the second conveyance speed to be higher than the first conveyance speed.

(16) The image forming system of Structure (14), wherein the first processing apparatus is an image forming apparatus for printing image information onto a recording sheet.

(17) The image forming system of Structure (14), wherein the second processing apparatus is a finisher for conducting at least one of punching, folding and stapling processing to the recording sheet.

Further, the more preferable structures (18) to (23) to achieve the object are as follows.

(18) An image forming system comprising an image forming apparatus connected with a plurality of finishers and containing the processing mode wherein: the first finisher connected immediately after the image forming apparatus receives the sheet from the image forming apparatus, conveys it at the first conveyance speed at the ejection port of the image forming apparatus, changes the speed to the second conveyance speed higher than the first conveyance speed thereafter, and conveys the sheet in the sheet conveyance path between processing sections at the second conveyance speed and ejects it; and the second finisher connected with the first finisher conveys the sheet in the sheet conveyance path between processing sections at the second conveyance speed and ejects it.

(19) The aforementioned image forming system described in (18) wherein the image forming apparatus has a sheet ejection sensor, and sends the information on the first conveyance speed and the information on the distance between the sheet ejection sensor and the ejection port of the image forming apparatus, to the first finisher.

(20) The aforementioned image forming system described in (19) wherein the aforementioned image forming apparatus has a mode of ejecting sheet at various ejection speeds, and the aforementioned first finisher conveys the sheet at a standardized second conveyance speed equal to or higher than the maximum conveyance speed at the ejection port of the image forming apparatus, in all modes, and ejects the sheet.

(21) The aforementioned image forming system described in any one of (18) through (20) wherein the aforementioned finisher receives the information on the distance between the sheet ejection sensor provided on the first finisher and the ejection port of the finisher, and the information on the second conveyance speed, from the first finisher.

(22) An image forming system comprising an image forming apparatus connection with a plurality of finishers wherein the aforementioned finisher has a finisher control section for receiving information on the distance between the sheet ejection sensor installed on the image forming apparatus and the ejection port, and the ejection port and the information on the sheet conveyance speed at the ejection port, thereby performing conveyance control.

(23) The image forming system described in (21) wherein the aforementioned finisher conveys and ejects the sheet at a conveyance speed higher than that at the ejection port.

In an image forming system composed of an image forming apparatus connected with a plurality of finishers, standardized implementation of sheet conveyance control as the entire system is enabled according to any one of (18) through (21) and (23). This arrangement ensures simplified control, reduces the rate of occurrence of such a trouble as jamming and allows high speed processing in the finisher.

In the finisher of the preceding stage of the image forming system connected with a plurality of finishers, the structure according to any one of (19), (21) and (22) allows the finisher of the succeeding stage to perform smooth conveyance of sheet, even when sheet is ejected at various ejection speeds in conformity with processing modes.

Even when the function or model has been changed in the finisher of the preceding stage, this arrangement eliminates the need of changing the control section of the finisher of the succeeding stage; hence it removes the necessity of developing a new model devoid of improved performances and minimizes the maintenance loads.

DETAILED DESCRIPTION OF THE PREFERRED EMBODIMENT

Figure 2:
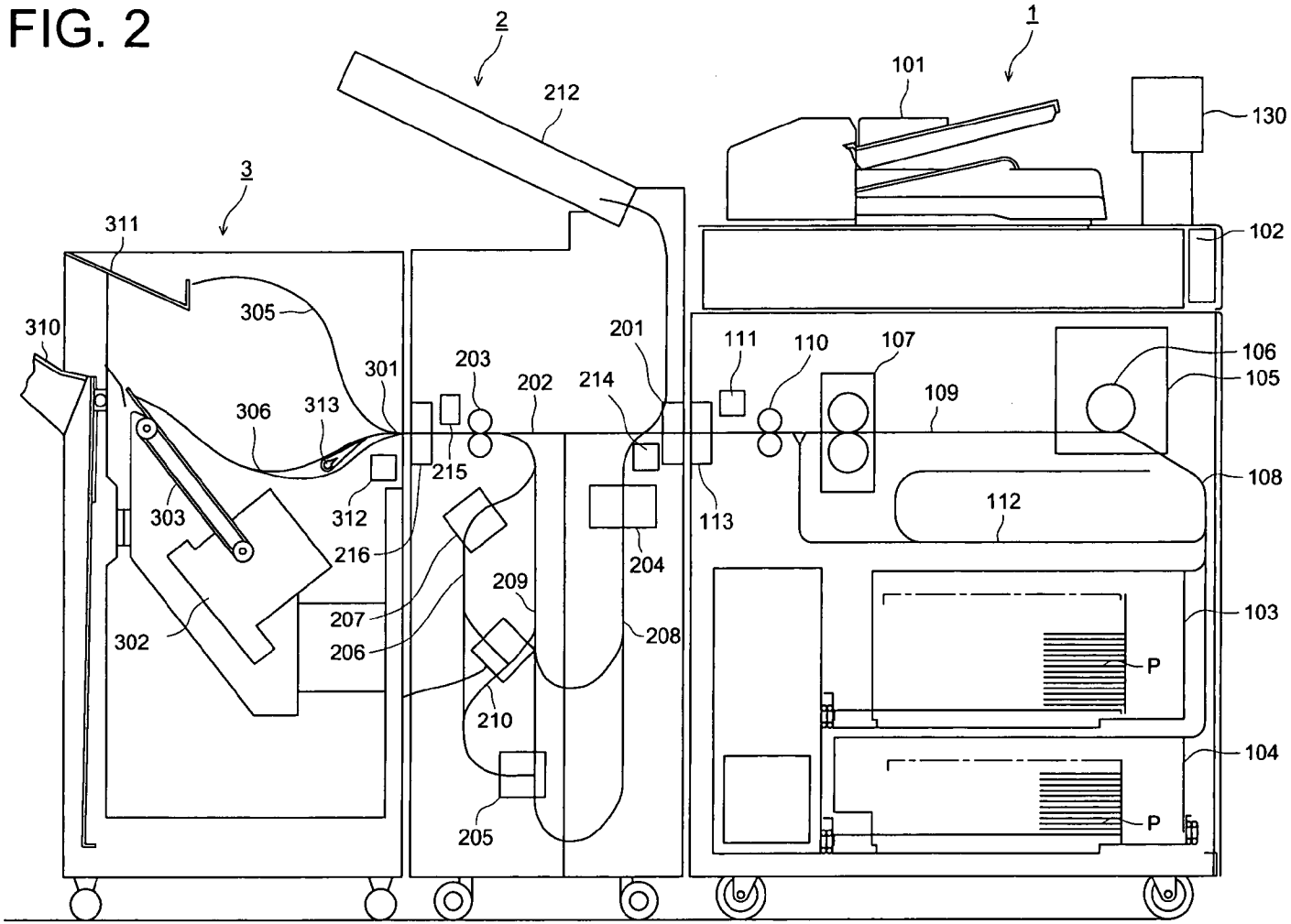
FIG. 2 is an overall diagram representing an image forming system as an embodiment of the present invention.

FIG. 2 is an overall diagram representing an image forming system as an embodiment of the present invention. This image forming system is composed of an image forming apparatus 1, first finisher 2 and second finisher 3.

An automatic document conveyance apparatus 101 and an image read apparatus 102 are mounted on the top of the image forming apparatus 1, and a printer is located on the lower portion of the image forming apparatus 1.

In the printer, numerals 103 and 104 denote sheet store sections for sheet P. It contains a photoconductor 106. An image is formed on sheet P in an image forming section 105 for forming an image on the sheet P by the electrophotographic process, and the formed image is fixed on sheet P by the fixing apparatus 107.

An image is formed on the sheet P supplied by a sheet store section 103 or 104. The sheet P with an image formed thereon is ejected from the ejection port 113 by an ejection roller 110.

Sheet conveyance paths include a sheet conveyance path 108 from the sheet store sections 103 and 104 to the image forming section 105; a sheet conveyance path 109 from image forming section 105 to ejection port 113 through the fixing apparatus 107 and ejection roller 110; and a back conveyance path 112 for reversing and conveyance.

The image forming modes includes a single side face down ejection mode, a single side face up ejection mode and a double-side mode. In the single side face down ejection mode, the sheet P with an image formed on the one side is reversed by the processing of reversing, and is conveyed and ejected by the ejection roller 110.

In the single side face up ejection mode, the sheet P with an image formed on the one side and conveyed to the sheet conveyance path 109 is directly conveyed and ejected by the ejection roller 110.

In the double-side mode, sheet P, with an image formed on one side, having passed the fixing apparatus 107 is conveyed downward to go through the back conveyance path 112. After having been reversed, the sheet is conveyed to the sheet conveyance path 108 again.

A back face image is formed on the back face of the sheet P conveyed again by the image forming section 106. The sheet P with back face image formed thereon passes through the fixing apparatus 107, and is conveyed and ejected by the ejection roller 110. Numeral 130 denotes an operation section. Various modes of the image forming apparatus 1 and output modes using the first and second finisher are set by the operation of the operation section 130.

The first finisher 2 is a finisher for performing at least one of punching, stapling, stacking and shifting. In the illustrated example, it contains a punching processing section 204 and folding sections 205, 206 and 207.

The first finisher 2 is provided with a sheet conveyance section 212 for the additional sheet such as inter-sheet, which is added to the sheet, carrying an image, discharged from the image forming apparatus 1. The sheet P discharged from the image forming apparatus 1 and introduced from a sheet inlet 201 provided with an inlet sensor 214 passes through a horizontal linear sheet conveyance path 202, and is ejected from the ejection port 216 by the ejection roller 203 or travels along the sheet conveyance path 208 extending downward. The sheet P having traveled downward is punched by the punching processing section 204 or is folded by passing through the folding sections 205, 206 and 207. Then the sheet P is ejected from the ejection port 216 by the ejection roller 203. Use of three folding sections 205, 206 and 207 allows the sheet to be folded in various forms; in two folding, three folding in the shape of letter Z or in three folding inward.

The second finisher 3 is a finisher for performing at least one of punching, folding, stacking and stapling. In the illustrated example, it has a stapling section 302 and a stacker 303 to apply stapling or shifting to the sheet and to eject it into an elevating ejection tray 310.

The second finisher 3 has a stationary ejection tray 311. In a low-volume image forming jobs, sheet P is ejected into a stationary ejection tray 311.

After a predetermined number of sheets have been accumulated in the stacker 303, stapling is carried out to sheet by the stapling section 302. The bundle of processed sheet P goes up the stacker 303 and is ejected into the elevating ejection tray 310.

In a low-volume image forming jobs, the sheet conveyance path 305 is selected and sheet P is ejected into the stationary ejection tray 311.

In the shifting and ejection, sheet P is conveyed along the sheet conveyance path 306 to the stacker 303 where it is stopped. Then sheet P is subjected to processing of shifting at the stacker 303 and is ejected to the elevating ejection tray 310. In the stapling apparatus, sheet P travels along the sheet conveyance path 306. The sheets are stacked in the number preset on the stacker 303. The stacked sheets of sheet P are stapled by the stapling section 302, and are conveyed to the upper left over the stacker 303. Then they are ejected into the elevating ejection tray 310.

Even in the mode where stapling or shifting is not carried out, sheet P is ejected to the elevating ejection tray 310 through the sheet conveyance path 306 if high-volume image formation is performed. To put it another way, in the process of forming a large amount of images, sheet P travels along the sheet conveyance path 306 and is ejected into the elevating ejection tray 310 after traveling straight without passing through the stacker 303.

Figure 3:
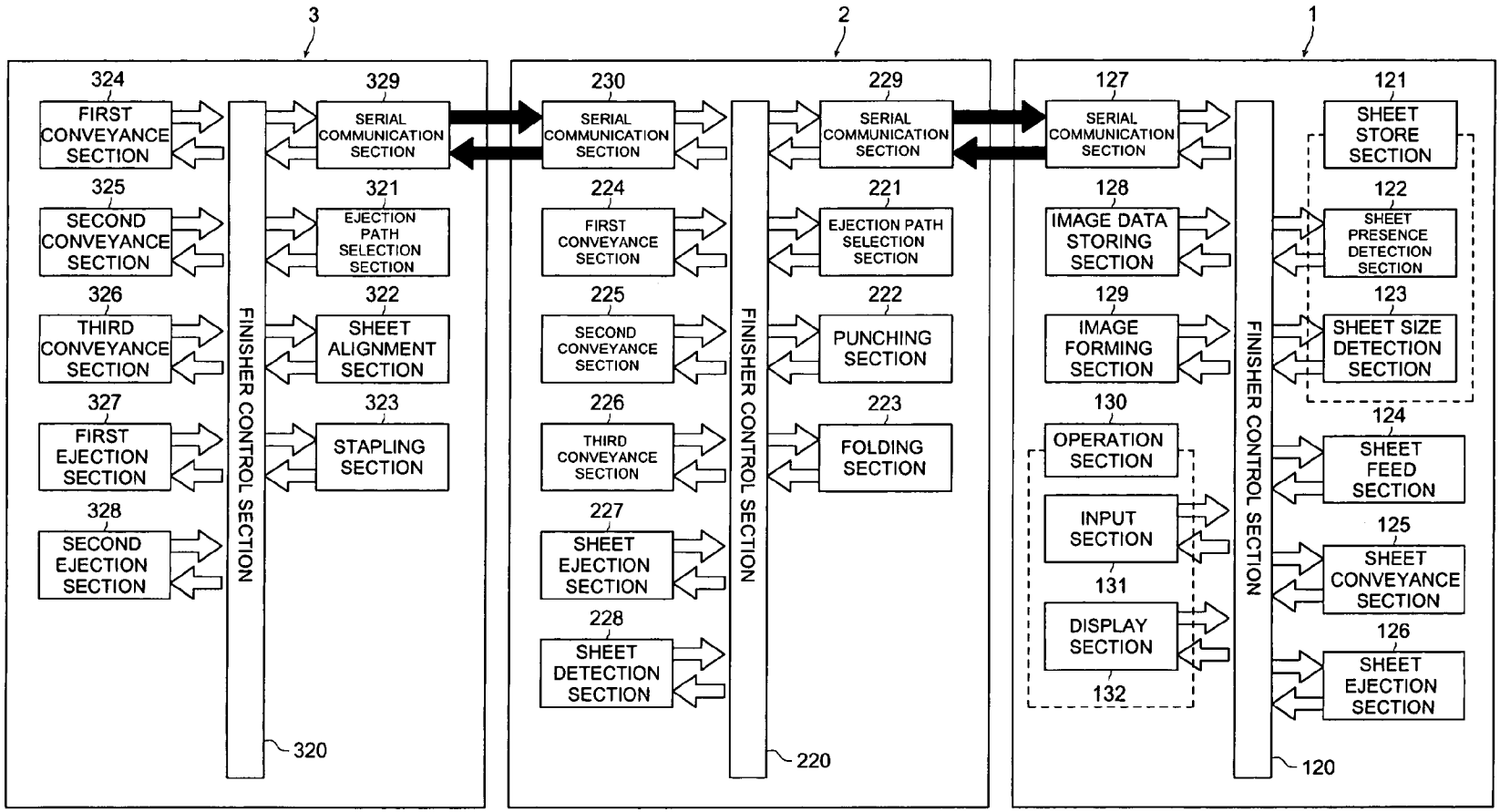
FIG. 3 is a block diagram representing the control system of the image forming system shown in FIG. 2.

FIG. 3 is a block diagram representing the control system of the image forming system shown in FIG. 2.

Numeral 120 denotes an image forming apparatus control section for overall control of the image forming system such as processing of the system as a whole, including image reading, image formation, sheet conveyance and processing by the finisher.

Numeral 121 denotes a sheet store section as a control unit. It controls start of the sheet conveyance in the sheet store sections 103 and 104.

Numeral 122 denotes a sheet presence detection section composed of various sensors such as a sheet sensor. It contains sensors mounted on the recording sheet storage section and sheet conveyance path. The ejection sheet sensor 111 is a component of the sheet presence detection section 122.

Numeral 123 denotes a sheet size detection section and is composed of the sensors provided on the sheet store sections 13 and 104 in FIG. 2. It should be noted that one sensor serves as both the sheet presence detection section 122 and sheet size detection section 123 in some cases.

The sheet conveyance section 124 provides conveyance control on the sheet conveyance path 108 in FIG. 2.

The conveyance section 125 provides conveyance control on the double-side conveyance section 109 in FIG. 2.

The sheet ejection section 126 controls the ejection roller 110.

The image data storing section 128 stores the image data generated by the image read apparatus 102 in FIG. 2 and the image data received from outside via the network. It is composed of a large capacity memory such as a semiconductor memory and hard disk memory.

An image forming section 129 controls the image forming section 105 and fixing apparatus 107 of FIG. 2.

An operation section 130 comprises an input section 131 including operation keys or the like and a display section 132 having a LCD panel or CRT.

Numeral 220 denotes a finisher control section for overall control in the first finisher 2.

An ejection path selection section 221 is used to select whether the sheet having been received from the image forming apparatus 1 and sheet supplied from the sheet conveyance section 212 are to be rejected through the sheet conveyance path 202 or though the sheet conveyance path 208. The ejection path selection section selects the sheet conveyance path for the folding sections 205, 206 and 207 to carry out various types of folding.

A punching section 222 controls the punching processing section 204.

A folding section 223 controls the folding sections 205, 206 and 207 in FIG. 2.

A first conveyance section 224 controls the conveyance along the sheet conveyance path 202 in FIG. 2.

A second conveyance section 225 controls the conveyance along the sheet conveyance path 208 in FIG. 2.

A third conveyance section 226 controls the conveyance between folding sections along sheet conveyance paths 209, 210 and 211 in FIG. 2.

A detection section 228 includes a sensor for detecting sheet. The inlet sensor 201 and ejection sensor 215 in FIG. 2 constitute the detection section 228.

Numeral 320 is a finisher control section for overall control of the second finisher.

An ejection path selection section 321 controls the selection to determine if the sheet received from the first finisher 2 should be ejected to the stationary ejection tray 311 through the sheet conveyance path 305 in FIG. 2, or to the elevating ejection tray 310 through the sheet conveyance path 306 and stacker 303.

A sheet alignment section 322 controls the alignment of sheet in the stacker 303 of FIG. 2. It controls the drive of the regulating plate for regulate the side edge of the stacked sheets of sheet P, thereby aligning the sheets and pushing up and ejecting the stapled sheet P.

A stapling section 323 controls the stapling section 302 in FIG. 2.

A first sheet conveyance section 324 controls the conveyance along the sheet conveyance path 306 in FIG. 2.

A second sheet conveyance section 325 controls the conveyance along the sheet conveyance path 305 in FIG. 2.

A third sheet conveyance section 326 controls the conveyance from the stacker 303 to the stationary ejection tray.311 in FIG. 2.

A first sheet ejection section 327 controls ejection of sheet to the elevating ejection tray 310 and elevation of the elevating ejection tray 310.

A second sheet ejection section 328 controls ejection of sheet to the stationary ejection tray 311.

Communication among the image forming apparatus 1, first finisher 2 and second finisher 3 is carried out by the serial communication sections 127 and 229, and between 230 and 329.

Figure 4:
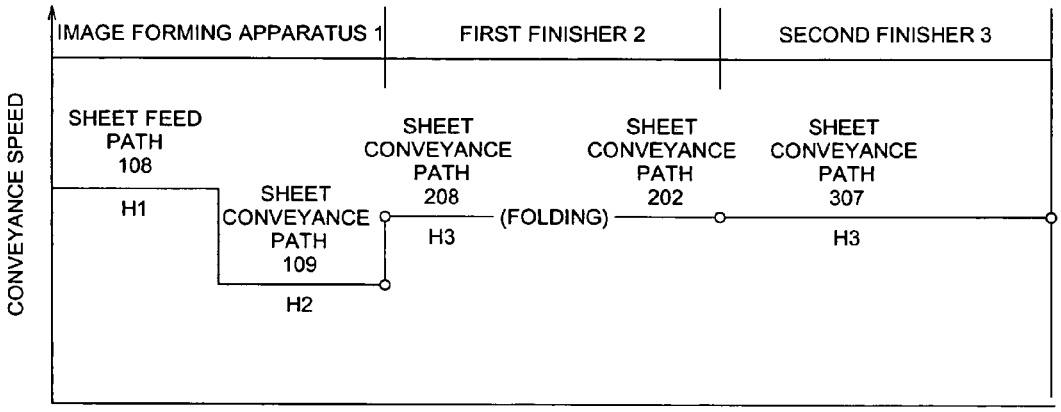
FIG. 4 is a diagram representing the sheet conveyance control in the processing of folding.

The sheet conveyance control by the control system shown in FIG. 3 is carried out as shown in FIG. 4 representing the sheet conveyance speed in each apparatus. FIG. 4 shows an example of folding, and FIG. 5 an example of stapling.

In the example shown in FIG. 4, sheet is conveyed out of the sheet store section 121 and is conveyed along the sheet conveyance path 108 at the conveyance speed Hi by the sheet conveyance section 124.

After having been stopped temporarily at the registration station, sheet is conveyed along the sheet conveyance path 109 at the conveyance speed H2 (first conveyance speed) lower than the conveyance speed H1 by the conveyance section 125, and is ejected from the sheet ejection section 126 into the first finisher 2.

In the first finisher 2, sheet is conveyed along the sheet conveyance paths 208 and 209 at the conveyance speed H3 (second conveyance speed) higher than the conveyance speed H2 by the first and second conveyance sections 225 and 226. After having been folded, sheet is ejected from the sheet ejection section 227 at the conveyance speed H3 into the second finisher 3. In the second finisher 3, the sheet is conveyed along the sheet conveyance path 306 at the conveyance speed H3 by the conveyance section 324, and is ejected into the elevating ejection tray 310.

As described above, the conveyance speed H3 along the sheet conveyance paths 208 and 202 before and after folding in the first finisher 2 and the conveyance speed H3 along the sheet conveyance path 306 in the second finisher 3 are set at a value higher than the conveyance speed H2 at the ejection port 113.

Figure 5:
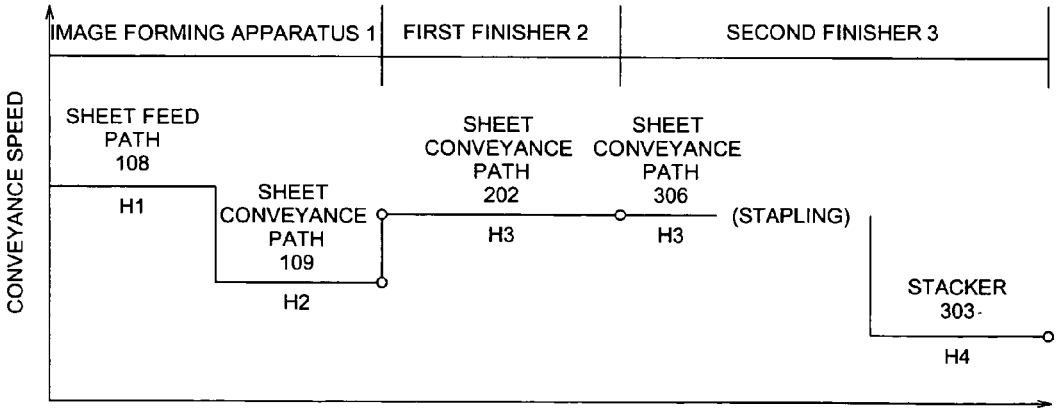
FIG. 5 is a diagram representing the sheet conveyance control in the processing of stapling.

In the example shown in FIG. 5, the sheet having been processed by the image forming apparatus 1 and ejected at the conveyance speed H2 (first conveyance speed) similarly to the case of FIG. 4 is conveyed along the sheet conveyance path 202 by the sheet conveyance section 224 at the conveyance speed H3 (second conveyance speed) higher than the conveyance speed H2 in the first finisher 2, and is ejected into the second finisher 3.

In the second finisher 3, sheet is conveyed along the sheet conveyance path 306 at the conveyance speed H3 by the second sheet conveyance section 325, and is stopped by the stacker 303. After having been stapled, sheet is conveyed at the conveyance speed H4 lower than the conveyance speed H3, and is ejected into the elevating ejection tray 310.

Switching of conveyance speed from H2 to H3 in FIGS. 4 and 5 is controlled by the finisher control section 220 based on the signal coming from the sheet detection section 228.

To put it another way, the conveyance speed H2 is switched to H3 according to the signal from the sheet detection section 228 that detects passage of the trailing edge of the sheet ejected from the image forming apparatus 1 at the conveyance speed H2.

Figure 6:
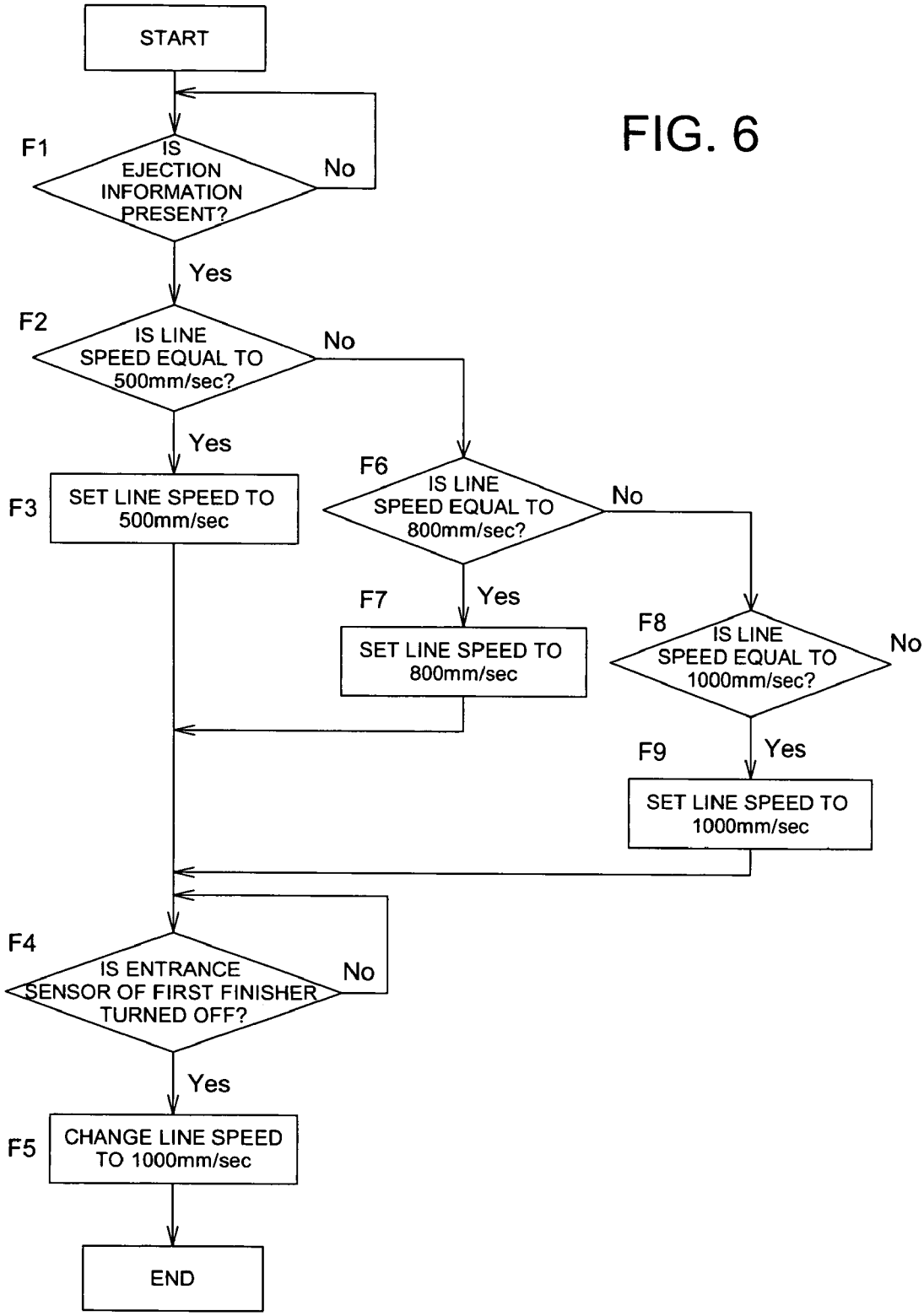
FIG. 6 is a flowchart showing the conveyance speed switching control.

FIG. 6 is a flowchart showing the conveyance speed switching control using the sheet detection section 228.

Decision in step F1 on whether or not ejection information is present is made in conformity to the signal sent from the sheet ejection sensor 111 located in the sheet presence detection section 122 of the image forming apparatus 1.

If there is ejection information, the conveyance speed at the sheet inlet section of the first finisher 2 is set. To set this conveyance speed is to control of adding the conveyance speed at the inlet 201 of the first finisher to the conveyance speed at the ejection port 113 of the image forming apparatus 1. As shown in the case of F2 and F3, F6 and F7, and R8 and F9, when the conveyance speed at the ejection port 113 is 500 mm/sec., the conveyance speed at the inlet sensor 201 is 500 mm/sec.; when the conveyance speed at the ejection port 113 is 800 mm/sec., the conveyance speed at the inlet sensor 201 is 800 mm/sec.; and when the conveyance speed at the ejection port 113 is 1000 mm/sec., the conveyance speed at the inlet sensor 201 is 1000 mm/sec.

Upon detection of passing of the trailing edge of sheet through the inlet sensor 214 in the sheet detection section 228 of the first finisher 2 (Yes in F4), the conveyance speed is set to 1000 mm/sec. and sheet is conveyed.

In the step F5 and thereafter in FIG. 6 in the first finisher 2, sheet is conveyed along the main conveyance path of the first finisher 2 and second finisher 3, namely, the conveyance path between processing sections at the conveyance speed 1000 mm/sec. (H3), as shown in FIGS. 4 and 5.

As is clear from FIG. 6, conveyance at the inlet sensor 201 of the first finisher 2 is controlled under the conveyance conditions of the image forming apparatus 1, until passing of the trailing edge of sheet is detected by the inlet sensor 214 provided at the sheet inlet 201.

The above description also applies to the second finisher 3. The conveyance is controlled under the conveyance conditions of the second finisher 3, until passing of the trailing edge of sheet is detected by the sensor 312 that is provided at the sheet inlet 301 of the second finisher 3.

In other words, in the finisher, control at the sheet inlet is provided under the conveyance conditions in the finisher of the preceding stage, until the trailing edge of the sheet passes by.

In the control carried out under the conveyance conditions of the apparatus of the preceding stage, information on the conveyance conditions of the apparatus in the preceding stage must be captured by the apparatus of the succeeding stage. For example, to improve the processing efficiency in the second finisher 3, two sheets of sheet conveyed in succession are conveyed one on top of the other. To be more specific, to improve productivity, when the sheet is conveyed continuously with the space between sheets minimized, two sheets are conveyed one on top of the other in the second finisher 3. A bypass gate 313 is provided in the sheet conveyance path 306 close to the sheet inlet, and the preceding sheet and succeeding sheet are conveyed one on top of the other, by switching of this bypass gate. In this case, the setting of the stop time for stopping the preceding sheet temporarily is controlled according to the information on conveyance speed at the sheet ejection port and sensor distance in the finisher of the preceding stage., namely the first finisher 2.

According to the present invention, when sheet is sent from the finisher of the preceding stage to the finisher of the succeeding stage, namely, from the image forming apparatus 1 to the first finisher 2, and from the first finisher 2 to the second finisher 3 in the example of FIG. 2, information on the conveyance speed H at the ejection port of the apparatus of the preceding stage and information on the sensor distance D, namely, information between the sheet ejection sensor and the ejection port is conveyed to the finisher of the succeeding stage.

Figure 1:
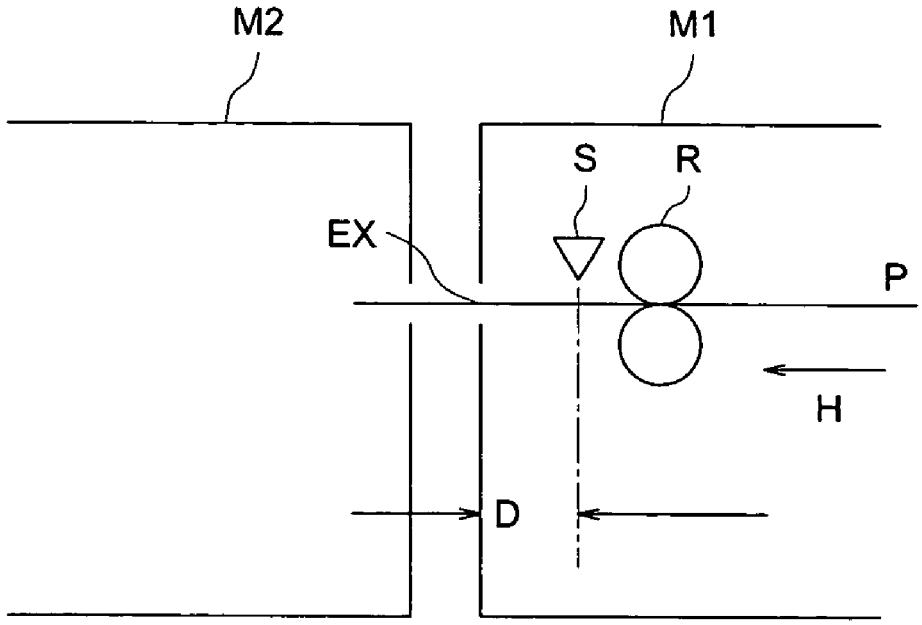
FIG. 1 is a conveyance control diagram.

The conveyance speed H and sensor distance D are as shown in FIG. 1.

As shown above, the first finisher having received sheet from the finisher of the succeeding stage, that is, image forming apparatus 1, and the second finisher 3 having received sheet from the first finisher 2 control the conveyance of sheet, using the information shown in FIG. 1, without identifying the model of the finisher of the preceding stage.

These items of information are transmitted through the serial communication sections 127, 229, 230 and 329 shown in FIG. 3. To put it more specifically, these items of information are transmitted together with the operation command issued from the image forming control section 120 to the finisher control sections 220 and 320 before execution of the image forming job starts.

What is claimed is:

1. An image forming system comprising:

(a) an image forming apparatus capable of conveying a recording sheet at a predetermined speed;

(b) at least one finisher capable of conveying the sheet ejected from the image forming apparatus at a prescribed speed to process the sheet; and (c) a controller for changing a conveyance speed of the recording sheet in the finisher to be higher than that of the sheet in the image forming apparatus, wherein the controller changes the conveyance speed of the recording sheet in the finisher after the sheet has been delivered from the image forming apparatus to the finisher, and wherein the image forming apparatus comprises a sheet detection sensor provided in the vicinity of a sheet ejection position thereof, and an information transmitter for transmitting information on a sheet conveyance speed in the image forming apparatus and a distance between the sheet detection sensor and the sheet ejection position, to the finisher.

2. The image forming system of claim 1, wherein the image forming apparatus has a plurality of sheet conveyance modes including different sheet conveyance speeds, and the finisher conveys the sheet at a sheet conveyance speed higher than that in the plurality of sheet conveyance modes.

3. The image forming system of claim 1, comprising a first finisher connected with the image forming apparatus and a second finisher connected with the first finisher.

4. The image forming system of claim 3, wherein the first finisher comprises a sheet detection sensor provided in the vicinity of a sheet ejection position thereof, and an information transmitter for transmitting information on the sheet conveyance speed in the first finisher and a distance between the sheet detection sensor and the sheet ejection position, to the second finisher.

5. An image forming system comprising:

(a) an image forming apparatus capable of ejecting a recording sheet to a next processing station at a predetermined speed;

(b) at least one finisher capable of conveying at a prescribed speed the sheet ejected from the image forming apparatus to process the sheet; and (c) a controller for changing a conveyance speed of the recording sheet in the finisher to be higher than an ejection speed of the sheet ejected from the image forming apparatus, wherein the image forming apparatus comprises a sheet detection sensor provided in the vicinity of a sheet ejection position thereof, and an information transmitter for transmitting information on a sheet conveyance speed in the image forming apparatus and a distance between the sheet detection sensor and the sheet ejection position, to the finisher.

6. The image forming system of claim 5, wherein the controller changes the conveyance speed of the sheet in the finisher after the sheet has been delivered from the image forming apparatus to the finisher.

7. The image forming system of claim 5, wherein the image forming apparatus has a plurality of sheet conveyance modes including different sheet conveyance speeds, and the finisher conveys the sheet at a sheet conveyance speed higher than that in the plurality of sheet conveyance modes.

8. An image forming system comprising:

(a) an image forming apparatus capable of conveying a recording sheet at a predetermined speed;

(b) at least one finisher capable of changing a conveyance speed of the sheet therein for processing the sheet ejected from the image forming apparatus;

(c) an information transmitter for transmitting information on a sheet conveyance speed in the image forming apparatus to the finisher; and (d) a controller for controlling the conveyance speed in the finisher according to the information from the information transmitter, wherein the image forming apparatus comprises a sheet detection sensor provided in the vicinity of a sheet ejection position of the image forming apparatus, and the information transmitter transmits information on a distance between the sheet detection sensor and the sheet ejection position and the sheet conveyance speed in the image forming apparatus, to the finisher.

9. The image forming system of claim 8, wherein the controller controls the conveyance speed in the finisher to be higher than a conveyance speed at the sheet ejection position of the image forming apparatus.

10. An image forming system comprising:

(a) a first processing apparatus for conveying a recording sheet to a next processing station at a first conveyance speed, having a sheet detection sensor in the vicinity of a sheet ejection position;

(b) a second processing apparatus for receiving the sheet ejected from the first processing apparatus, conveying at a second conveyance speed and conducting a desired processing to the sheet;

(c) an information transmitter for transmitting information on a distance between the sheet detection sensor and the sheet ejection position and the first conveyance speed, to the second processing apparatus; and (d) a controller for controlling the second conveyance speed according to the information from the information transmitter.

11. The image forming system of claim 10, wherein when the sheet is delivered from the first processing apparatus to the second processing apparatus, the controller controls so that first conveyance speed is equal to the second conveyance speed.

12. The image forming system of claim 11, wherein the first processing apparatus is an image forming apparatus for printing image information onto a recording sheet.

13. The image forming system of claim 11, wherein the second processing apparatus is a finisher for conducting at least one of punching, folding and stapling processing to the recording sheet.

14. The image forming system of claim 10, wherein after the sheet has been delivered from the first processing apparatus to the second processing apparatus, the controller makes the second conveyance speed to be higher than the first conveyance speed.

15. An image forming system comprising:

a) an image forming apparatus capable of conveying a recording sheet at a predetermined speed;

(b) at least one finisher capable of conveying the sheet ejected from the image forming apparatus at a prescribed speed to process the sheet;

(c) a controller for changing a conveyance speed of the recording sheet in the finisher to be higher than that of the sheet in the image forming apparatus, wherein the controller changes the conveyance speed of the recording sheet in the finisher after the sheet has been delivered from the image forming apparatus to the finisher;

(d) a first finisher connected with the image forming apparatus; and (e) a second finisher connected with the first finisher, wherein the first finisher comprises a sheet detection sensor provided in the vicinity of a sheet ejection position thereof, and an information transmitter for transmitting information on the sheet conveyance speed in the first finisher and a distance between the sheet detection sensor and the sheet ejection position, to the second finisher.

* * * * *